United States Patent [19]

Netzer

[11] Patent Number: 4,691,397

[45] Date of Patent: Sep. 8, 1987

[54] LIFE SUPPORT CARRYING APPARATUS

[76] Inventor: Ronald G. Netzer, 1037 55th St., Downers Grove, Ill. 60516

[21] Appl. No.: 871,878

[22] Filed: Jun. 9, 1986

[51] Int. Cl.[4] ..... A47B 23/02; A47C 21/00

[52] U.S. Cl. ..... 5/507; 5/508; 248/214; 280/30

[58] Field of Search ..... 5/508, 507, 503; 248/214, 219; 280/30, 655

[56] References Cited

U.S. PATENT DOCUMENTS

| | | | |
|---|---|---|---|
| D. 163,627 | 6/1951 | Paterniti | 5/507 |
| 1,267,046 | 5/1918 | Beaird | 248/214 |
| 2,696,963 | 12/1954 | Shepherd | 5/503 |
| 4,457,527 | 7/1984 | Lowery | 280/30 |
| 4,489,454 | 12/1984 | Thompson | 5/508 |

*Primary Examiner*—Alexander Grosz

[57] ABSTRACT

A device which carries the life supporting devices of a bedridden patient that cooperates with the footboard of the bed in a manner such that the weight of the assemblage is generally centered with respect to a cross section of the footboard so that there is very little twisting movement. The device includes a table-like surface for supporting life support devices. W-shaped flanges which cooperate with the headboard and wheels that allow the entire assembly to be rolled to another location. A first group of brackets hold the I.V. poles when they are in use, and a second group are provided whereby the I.V. poles can be used as handles.

7 Claims, 5 Drawing Figures

LIFE SUPPORT CARRYING APPARATUS

FIELD OF THE INVENTION

The present invention generally relates to a device for carrying life support devices either in cooperation with a wheeled patient transport device, such as a hospital bed, when a patient is present in the bed or independently thereof when it is necessary to move the life support devices to another location.

BACKGROUND OF THE INVENTION

As is normal during the treatment of an injured patient, it is necessary to move the patient to other locations in the hospital for surgery, special tests, etc. To my knowledge, both in the past and at present, it is generally the practice to place life support devices such as: oxygen cylinders, respirator, difibulator, etc. in the bed with the patient. Even under to best conditions this is not suitable since lines become tangled, pinched closed and disconnected. In the event of an emergency situation, it is absolutely necessary that the hospital staff have clear and unhindered access to the patient. Some emergencies even require the removal of the headboard for placement under the patient to provide additional support. Other procedures and devices have included extra attendants who carry the life support devices and/or means which secure to the hospital bed or are moved in conjunction therewith. Either technique has made for unwieldly situations, since hallways, doorways and elevators etc. are often not suitable for allowing the free passage of the extra attendant and/or the trail-along equipment. Additionally, after the patient reaches his destination, life support devices are available there such as in surgery. Thus, the life support devices which came with the patient must be moved to another location. It is during this period when the life support devices are being transported that the potential for being lost or damaged is high.

SUMMARY OF THE INVENTION

My invention provides a simple means that accommodates a patient's life support devices generally within the lateral boundaries of the hospital bed without extra attendants. Then, after the patient has been delivered to his destination, it converts into a hand truck cart means for transporting the life support devices to their next location.

The lift support carrying means which I have invented solves the problems previously mentioned. Firstly, it includes a securing means which is designed to complementarily mate with the footboard in such a manner that its weight as well as the weight of any on-board equipment will be distributed along the major axis of the footboard avoiding, if properly used, cantilevered loads. Since cantilevered loads and the like are avioded, my life support carrying means can be constructed of aluminum and requires minimal reinforcing material. Therefore, it is strong enough for the intended purpose yet light enough to be lifted up several feet and placed over the footboard by the average hospital employee.

Since the life supporting carrying means straddles the footboard it, remains generally within the lateral boundaries of the hospital bed itself. Thus, wherever the hospital bed could be moved by itself, it can also be moved with my life support carrying means, i.e. through a hallway, doorway, elevators, etc.

In practice, once the life support carrying means is firmly engaged with the footboard, the life support devices will be placed on a table-like surface designed for that purpose and which is centrally located over the securing means so that the load, which may run up to 50–70 pounds, will be distributed generally vertically down to the footboard and along its major axis. Once loaded, all of the lines from the life support devices will be extended and connected to the patient in an orderly, safe and tangle-free manner.

A special carrier is provided for the oxygen bottle within the lateral boundaries of the life support carrier means, yet in a manner whereby the gauges are visible to an attendant adjacent the head of the patient. Because of the openess of the table-like surface, most of the gauges, etc., associates with the life support devices will be visible to an attendant adjacent the head of the patient. Centrally located in the table-like surface are I.V. holder bushing means into which the I.V. holder means are inserted when it is necessary for them to support intravenous feeding containers. The I.V. poles are a diameter large enough and strong enough to allow the mounting of up to 4 I.V. pumps.

On each side of the table-like surface there extend tubular support means that are designed to cooperate with the I.V. holder means as will be hereafter explained.

One end of my life support carrying means is provided with a transport means such as a pair of wheels, an axle and a supporting frame. Directly adjacent thereto wall means are provided which has its major plane generally perpendicular to that of the table-like surface means.

Once the patient has been moved from the hospital bed for whatever purpose, for example surgery, the life support devices must be moved to the next desired location, since a duplicate group of life support devices will be available in surgery.

In practice, because of the limited weight-lifting capacity of most hospital attendants, all of the life support devices are removed and the life support carrying means is removed from the footboard and positioned on the floor in the same manner as a hand truck. In the same manner that one loads a hand truck, the life support devices are placed thereon with the exception of the I.V. holder means, which are inserted into the tubular support means at the ends opposite the wheels. The I.V. holder means once so inserted and adjusted for height provide the handles whereby my life support carrying means may be pivoted forward on the wheels and moved in hand truck fashion to the next desired location. A safety strap may be employed to secure the life support devices against both the wall means and the table-like surface.

It is therefore an object of this invention to provide a portable device adapted for attachment to the foot of a bed and particularly useful in hospitals to provide a means by which life support devices may be accommodated for patient use and then transferred independent of the bed to another location.

But another object of my invention is to provide a life support carrier means which obviates the previous practice of laying the life support devices on the bed with the patient or requiring an additional attendant to carry them.

Still another object of my invention is to provide a life support carrier means for securement to a hospital bed which lies substantially within the lateral boundaries of the bed and is thus out of the way and not easily hooked on door jambs or the like while the bed is being moved from on location to another.

Another object of this invention is to provide a device which accommodates life support devices for a bedridden patient and when not so employed to be capable of carrying said life support devices from one place to another within the hospital.

Yet another object of this invention is to provide a device which accommodates life support devices for a bedridden patient in a manner such that the weight of such devices is distributed generally equally upon the footboard of the hospital bed and thus necessitates less structural material.

BRIEF DESCRIPTION OF THE DRAWINGS

Having in mind the above objects and other attendant advantages that would be evident from an understanding of this disclosure, the invention comprises the devices, combinations, and arrangement of parts as illustrated in the presently preferred form of the invention which is hereinafter set forth in detail to enable those skilled in the art to readily understand the function, operation, construction and advantages of same when read in conjuction with the accompanying drawings in which.

DETAILED DESCRIPTION OF THE PRESENT INVENTION

Figure 2:
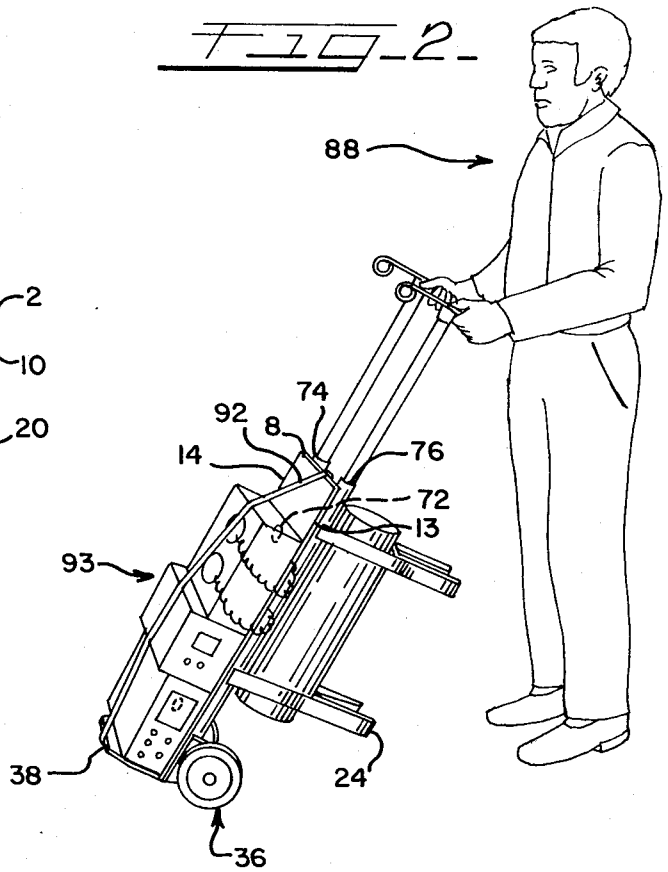
FIG. 2 is a perspective view showing my invention removed from a hospital bed, structurally arranged, and in a position for transportation.

Referring now to the drawings in detail wherein like reference characters indicate like parts throughout the several figures. The reference number 2 indicates generally the life support carrying means constructed in accordance with the invention and as mounted to a hospital bed means 12. The hospital bed 12 as utilized herein is of the type manufactured by Simmens-Hausted and is intended only as a representative sample; as will become hereafter apparent, by varying the securing means the life support means 2 can be adapted to be mounted on any number of structures.

The life support carrier means 2 incorporates a series of elements the first of which is a support frame means 4. The support frame means 4 includes a planar or table-like surface means 6 that in this embodiment supports the various other elements of my invention. Welding or any other convenient means may be employed for securing these elements. The table-like surface means 6 also includes first and second end means 8 and 10 and first and second side means 13 and 14.

Figure 1:
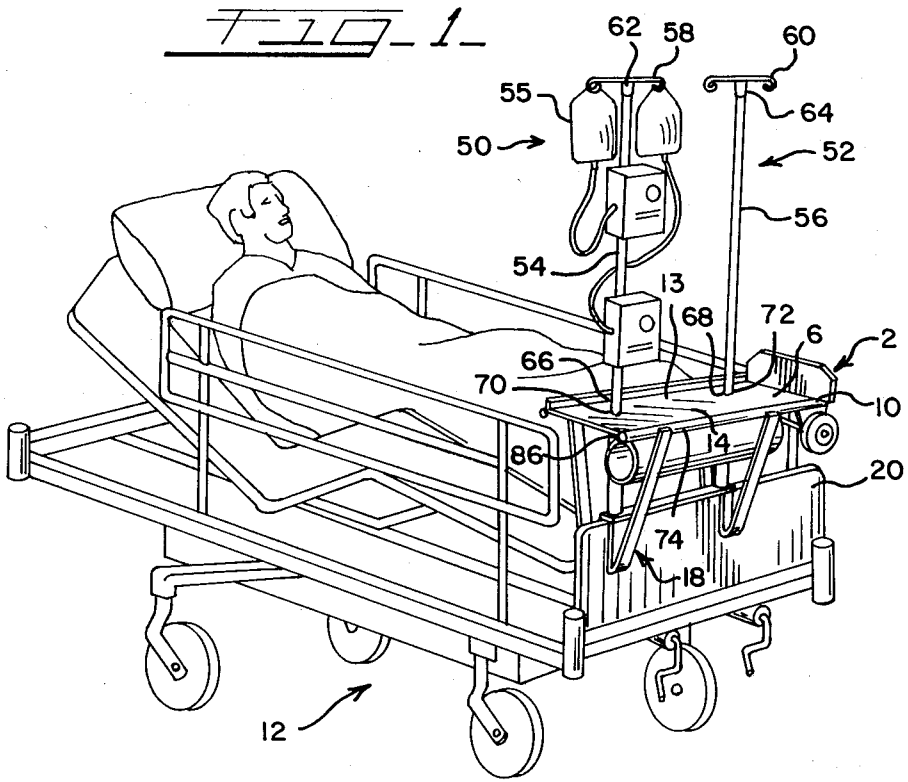
FIG. 1 is a perspective view showing a conventional hospital bed with my invention mounted on the footboard carrying a number of life support devices.

Located, in this particular embodiment, on a bottom side means 16 of the table-like surface means 6 is a securing means 18 for attachment to a footboard 20 of the hospital bed. As is apparent, the securing means 18 is centrally located and thus any load centrally located on the table-like surface means 6 will be transferred directly down to the footboard and distributed along its major horizontally extending axis, as shown in FIG. 1, to avoid cantilevered loads.

The securing means 18 includes first and second spaced apart downwardly projecting W-shaped flange means 22 and 24, which straddle the footboard 20 and are sized for firm yet removable engagement. As is apparent the exact nature of the securing means may vary depending upon the exact structure of the footboard, but the means should generally be capable of transmitting the external forces generated by the life support devices, etc., to the footboard such that they are generally perpendicular to the major axis of the footboard.

Figure 3:
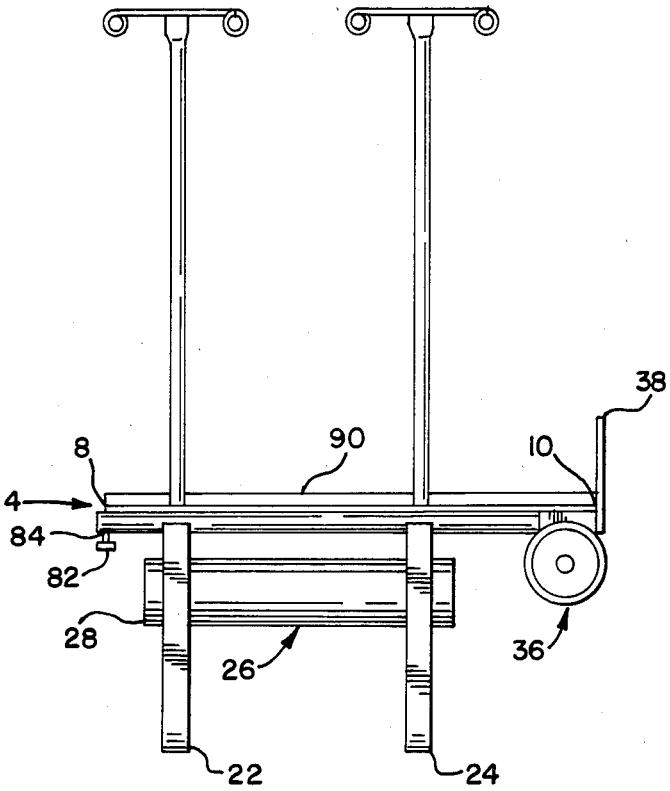
FIG. 3 is a side view of my invention removed from the bed.
Figure 4:
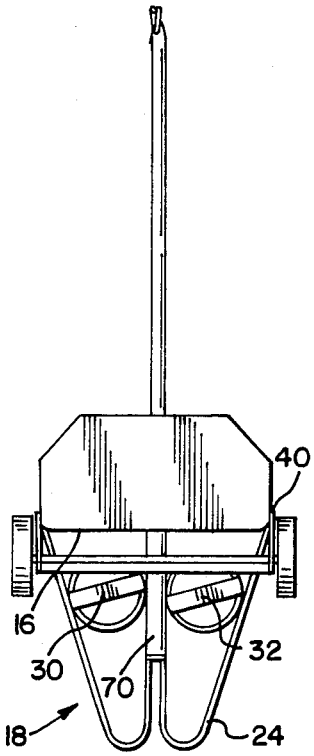
FIG. 4 is an end view of my invention, as shown in FIG. 3, looking from right to left.
Figure 5:
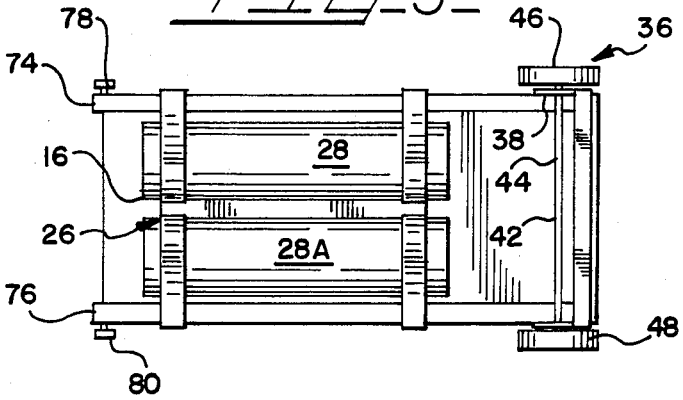
FIG. 5 is a bottom view of my invention as shown in FIG. 3.

Substantially within the lateral boundaries of the life support carrying means 2 is the oxygen bottle carrier means 26, as shown in FIG. 3. One or two standard oxygen bottles can be mounted, each of which has the conventional gauges, regulators, valving connected to the neck of the bottle. Although within substantially the lateral boundaries, the gauges etc. are close and exposed enough to be visible by an attendant or nurse adjacent to the right hand side of the patient. The oxygen bottle carrier means 26 includes indentical tubular-like structure means 28 and 28A and a means such as strap means 30 and 32 to close off one end thereof. Additionally, each may be provided with a rubber mat or lining means inside to prevent metal to metal contact as well as slippage of the oxygen bottle itself. Any suitable means may be employed to fix the oxygen bottle carrier means 26 to the securing means 18.

Secured near the second end means 10 of the table-like surface means 6 are the wheel or transportation means 36 and an abutting or wall means 38, which is secured directly to the second end means 10 and has its major plane generally perpendicular to that of the table-like surface means. The wall means 38 helps to prevent slippage of the life support devices off the table-like surface 6 during transportation to new locations.

The transport means 36 in a preferred embodiment includes: a generally U-shaped horizontally extending bracket means 40 secured to a bottom means 42 of the second end means 10 of the table-like surface means 6 and extends downwardly therefrom supporting a horizontal axle means 44 thereon. A pair of wheel means 46 and 48 are journalled on opposite ends of the axle means 44, being spaced sufficiently away from the table-like surface means that the life support carrier means 2 can be removed from the footboard and tilted into the position shown in FIG. 2. The wheel means are positioned back from the second end means 10 a sufficient distance that, when the life support carrying means 2 is positioned on the floor as shown in FIG. 2, it will function in a hand truck manner. It will be noted that the bottom portion of flange means 24 of the securing means 18 will help to support to life support carrier means 2 in a semi-upright position to facilitate loading and unloading.

Shown in FIG. 1 in actual use and in FIG. 2 in the transport position are dual purpose I.V. holder means 50 and 52. The I.V. holder means 50 and 52 employed in the present invention consist briefly of elongated tubular portion means 54 and 56. Hook or support means 58 and 60 are formed and mounted on the distal end means 62 and 64 for carrying the intravenous feeding container 55 or the like.

In operation the I.V. holders have their lower end means 66 and 68 snuggly secured within I.V. holder bushing means 70 and 72 which in the preferred embodiment are tubular means having an inside diameter to insure a snug, yet removable, engagement. The number of such I.V. holder bushing means is dependent on choice, but it has been found that the provision of two holder bushing means per life support carrier means 2 is sufficient for most purposes. As is apparent any means for detachably securing the I.V. holder means would be suitable.

When not in use the I.V. holder means can be retracted from the I.V. holder bushing means 70 and 72 and inserted into tubular support means 74 and 76 wherein they function as handles for transporting the life support carrier means 2 in a hand truck fashion. Also as is apparent, any means which cooperates with said I.V. holder means to form handles which aid in the movement of said life support carrying means 2 by said transport means 36 would be suitable.

In combination with the tubular support means 74 and 76, adjustment means 78 and 80 are provided which allow the height of the I.V. holder means 50 and 52 to be adjusted and then locked into place. Thus, the individual responsible for moving the life support carrier means 2 to the next location can adjust the I.V. holder means to a position comfortable to their particular physical stature. The adjustment means 78 and 80 are identical and thus just one will be described with the understanding that the other is substantially identical.

A thumb screw means 82 which has a threaded screw 84 cooperates with a tapped hole (not shown) located in any convenient location along the tubular support means 74. In the embodiment shown the tapped hole is located at an upper portion of the tubular means 74.

In operation, the elongated tubular portion of the I.V. means is telescopically inserted into a cavity means 86 existing within the tubular support means 74 which extend along the first and second side means 13 and 14. As so arranged, the thumb screw means 82 can be tightened to force the threaded screw 84 to abut the elongated tubular portion of the I.V. means to thus lock it into place at a convenient height for transportation by an attendant 88. Further explanation is deemed unnecessary, it being understood that loosening of the thumb screw 82 will permit movement of the elongated tubular portion means to allow variation in the transport position.

A lip means 90 is provided along the first side means 13 and in this embodiment extending the length thereof. The purpose of the lip means 90 is to prevent life support devices as shown in FIG. 1 from somehow falling off the table-like surface means 6 onto the patient. As is apparent a lip means could be provided on side 14 or lip means could be provided on both sides, or as wished.

An additional feature is a strap means 92 which gives additional support to the life support devices 93 when a patient is being treated as in FIG. 1 or when the life support devices are being transported to another location as in FIG. 2. In this embodiment the strap means 92 simply circles the table-like surface means 6 and clamps the life support devices thereagainst.

In operation, once the patient has reached his destination all the life support devices are disconnected and removed from the life support carrier means 2 including the I.V. holder means 50 and 52. The life support carrier means is then removed from the footboard 20 and placed hand truck-like on the floor. The first of the life support devices are placed on the table-like surface means 6 in an abutting position against the wall means 38 which, as is now apparent, forms a platform. The others are then stacked thereupon as shown in FIG. 2. The I.V. holder means 50 and 52 are inserted into the tubular support means 74 and 76, one on each side of the table-like surface means 6. The height of each I.V. holder means is set with the two adjustment means 78 and 80, the attendant grasps the I.V. holder means at a convenient point, and rolls the entire life support carrier means and life support devices to the next desired location.

Thus there has been provided, in accordance with the invention, A Life Support Carrying Apparatus that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the amended claims.

Having thus adquately described my invention, what I claim is:

1. A life support carrying means that accommodates life support devices of a bedridden patient substantially within the lateral boundaries of a hospital bed, said hospital bed having a footboard, comprising:

a table-like surface means for supporting said life support devices;

I.V. holder bushing means;

transport means secured to said table-like surface means and including wheel means and axle means;

oxygen bottle support means lying substantially within the boundaries of said table-like surface means;

securing means for complementary mating engagement with the footboard of said hospital bed whereby the weight of the carrying means and the life support devices can be generally distributed along the major plane of said footboard;

I.V. holder means having distal end means for carrying intravenous feeding container means and lower end means for engagement with said I.V. holder bushing means when carrying said intravenous feeding containers; and means cooperating with said I.V. holder means to form handle means which aid in movement by said transport means.

2. The life support carrying means of claim 1 wherein said table-like surface means includes first and second I.V. holder bushing means for cooperation with first and second I.V. holder means, and said means cooperating with said I.V. holder means being a tubular support means.

3. The life support carrying means of claim 1 wherein said table-like surface means includes first and second end means, said transport means being secure to said table-like surface means adjacent to said second end means whereby when positioned on the floor said life support carrying means functions in a hand truck-like manner.

4. A life support carrying means that accommodates life support devices on the footboard of a hospital bed comprising:

a table-like surface means having centrally located I.V. bushing means suitable for engagement with an I.V. holder means, and first and second end means, and first and second side means;

means for cooperating with said I.V. holder means being secured to said first and second side means whereby providing gripping means adjacent said first end means;

transport means secured to said second end means of said table-like surface means whereby said life support carrying means may be moved; and securing means fixed to said table-like surface means including downwardly projecting W-shaped flange means for straddling the footboard of said hospital bed and distributing the weight along the major axis thereof.

5. A life support carrying means for use with a bed to accommodate the life support devices of a bedridden patient and which independent of said bed can be made mobile to transport said life support devices comprising:

a support frame having a table-like surface means for accommodating life support devices;

securing means whereby said life support carrying means may be engaged with said bed when it is desired to treat a bedridden patient;

I.V. holder means;

transport means whereby said life support carrying means and said life support devices are movable independent of said bed;

means detachably engageable with said I.V. holder means when it is desirable to dispense intravenous feeding solution; and means cooperating with said I.V. holder means (whereby forming) handle means when it is desirable to make said life support carrying means mobile.

6. The life support carrying means of claim 5 wherein said bed includes a footboard and said securing means includes a means which transmits the external forces to said footboard such that they are generally perpendicular to the major axis of said footboard.

7. The life supporting carrying means of claim 6 wherein said securing means includes a downwardly projecting flange means which straddles said footboard.

* * * * *